US008199044B2

(12) United States Patent
Zabetakis

(10) Patent No.: US 8,199,044 B2
(45) Date of Patent: Jun. 12, 2012

(54) ARTIFICIAL DIELECTRIC COMPOSITES BY A DIRECT-WRITE METHOD

(75) Inventor: Daniel Zabetakis, Brandywine, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 469 days.

(21) Appl. No.: 12/414,741

(22) Filed: Mar. 31, 2009

(65) Prior Publication Data

US 2010/0245150 A1 Sep. 30, 2010

(51) Int. Cl.
*H01Q 17/00* (2006.01)

(52) U.S. Cl. ..... 342/1; 342/4; 342/175

(58) Field of Classification Search ..... 342/1–4, 342/175

See application file for complete search history.

(56) References Cited

U.S. PATENT DOCUMENTS

| | | | | |
|---|---|---|---|---|
| 4,847,732 | A * | 7/1989 | Stopper et al. | 361/739 |
| 4,977,013 | A * | 12/1990 | Ritchie et al. | 428/212 |
| 7,296,884 | B2 * | 11/2007 | Cohen et al. | 347/100 |
| 7,624,500 | B2 * | 12/2009 | Cai et al. | 29/846 |
| 7,892,632 | B2 * | 2/2011 | Zabetakis et al. | 428/220 |
| 2004/0179076 | A1 * | 9/2004 | Cohen et al. | 347/100 |
| 2005/0069718 | A1 * | 3/2005 | Voss-Kehl et al. | 428/447 |
| 2006/0003152 | A1 * | 1/2006 | Youngs | 428/212 |
| 2006/0269732 | A1 * | 11/2006 | Zabetakis | 428/292.1 |
| 2007/0296773 | A1 * | 12/2007 | Sharma et al. | 347/75 |
| 2008/0073114 | A1 * | 3/2008 | Kosowsky et al. | 174/262 |
| 2008/0084449 | A1 * | 4/2008 | Cai et al. | 347/20 |
| 2009/0202719 | A1 * | 8/2009 | Schoen et al. | 427/241 |
| 2009/0223703 | A1 * | 9/2009 | Winoto | 174/257 |
| 2009/0283304 | A1 * | 11/2009 | Winoto | 174/257 |
| 2010/0245150 | A1 * | 9/2010 | Zabetakis | 342/1 |

OTHER PUBLICATIONS

Shah et al, "Ink-Jet Printing of Catalyst Patterns for Electroless Metal Deposition," Langmuir, 1999, 15, 1584-1587.

Calvert, "Inkjet Printing for Materials and Devices," Chem. Mater., 2001, 13, 3299-3305.

* cited by examiner

*Primary Examiner* — John B Sotomayor

(74) *Attorney, Agent, or Firm* — Amy L. Ressing; Rebecca L. Forman

(57) ABSTRACT

The present invention is generally directed to an artificial dielectric composite having an electrically non-conducting substrate, an electrically non-conducting pattern on the substrate, and an electrically conducting coating on the pattern. The substrate may be a textile such as paper. The electrically non-conducting pattern may comprise palladium. A direct-write device, such as an inkjet printer, may be used to print the pattern onto the substrate. The electrically conducing coating may comprise nickel, gold, palladium, cobalt, iron, copper, or any combination thereof. Also disclosed is the related method of making the artificial dielectric composite.

11 Claims, 5 Drawing Sheets

ARTIFICIAL DIELECTRIC COMPOSITES BY A DIRECT-WRITE METHOD

BACKGROUND OF THE INVENTION

1. Field of the Invention

The present invention relates generally to dielectric composites and, more particularly, to artificial dielectrics prepared by a direct-write method.

2. Description of the Prior Art

Radar absorbing material (RAM) currently in military and commercial use are typically composed of high concentrations of iron powders in a polymer matrix. These materials are both very heavy and very costly, two key limitations to their adoption for many applications.

Various attempts to overcome these problems have involved the creation of artificial dielectrics, including ones based on conductive fiber-filled composites. While successful in many ways, these composites are beset by their own technical difficulties. Uniformity and consistency, critical attributes for a successful RAM, are difficult to achieve with fiber-filled composites as mixing and distribution of the fibers is opposed by the natural tendency of the fibers to clump. Also, there is not as great a cost reduction as expected with fiber-filled composites.

BRIEF SUMMARY OF THE INVENTION

The aforementioned problems are overcome in the present invention which provides an artificial dielectric composite having an electrically non-conducting substrate, an electrically non-conducting pattern on the substrate, and an electrically conducting coating on the pattern. The substrate may be a textile such as paper. The electrically non-conducting pattern may comprise palladium. A direct-write device, such as an inkjet printer, may be used to print the pattern onto the substrate. The electrically conducing coating may comprise nickel, gold, palladium, cobalt, iron, copper, or any combination thereof. Also disclosed is the related method of making the artificial dielectric composite.

The present invention has many advantages over the prior art. As compared to current RAM products, this invention is both less expensive to produce and lighter in weight. As compared to designs for dielectric RAM, the present invention shares the same advantage of light weight, while significantly reducing the cost. No advanced materials are required. This invention also removes one of the main obstacles to development of fiber-filled dielectrics, namely, the lack of uniformity. Using the technique of the present invention, it is easy to generate absolutely uniform patterns of metal tracings. As compared to known fiber-based dielectrics, it is also easy to vary the length, aspect ratio, shape, orientation, distribution, and other properties of a composite.

In addition, the present invention may be used to produce specific patterns or conductive surface features that will interact with electromagnetic radiation in specific ways. For example, wavelength-dependant resonating structures may be used to filter or attenuate specific wavelengths of radiation propagating as surface waves over a substructure.

Also, this invention represents a facile means to construct and test designs for RF devices such as microstrip antennas.

These and other features and advantages of the invention, as well as the invention itself, will become better understood by reference to the following detailed description, appended claims, and accompanying drawings.

DETAILED DESCRIPTION OF THE INVENTION

Figure 1:
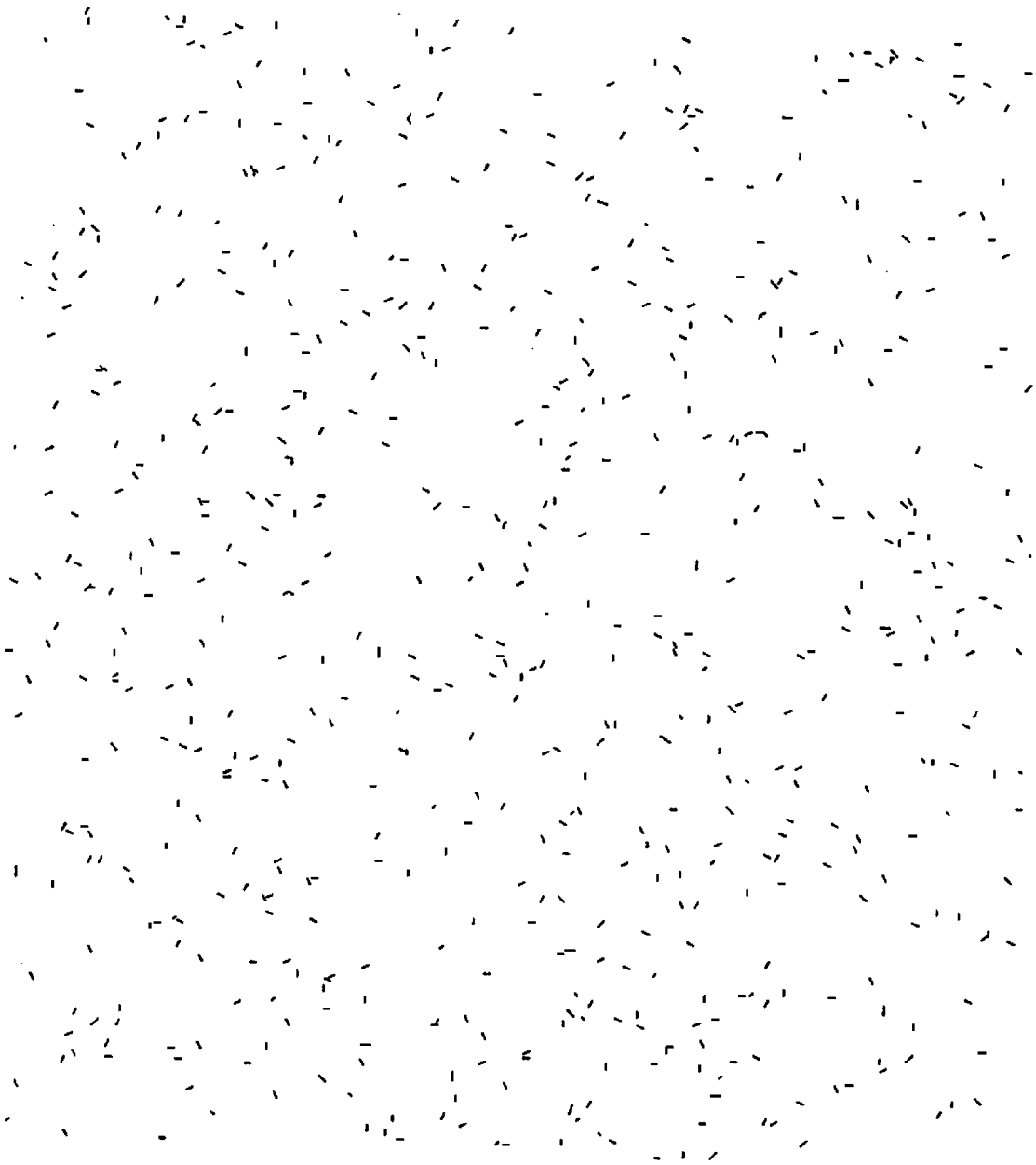
FIG. 1 is a pattern showing a series of short tracings in the form of straight line segments. The resulting composite is similar to a conductive fiber-filled dielectric sheet. The length of the fibers (as well as the density, distribution and orientation) determine the material's properties over a frequency range of interest. In addition to the random location and orientation shown, ordered or patterned tracings may also be produced.
Figure 2:
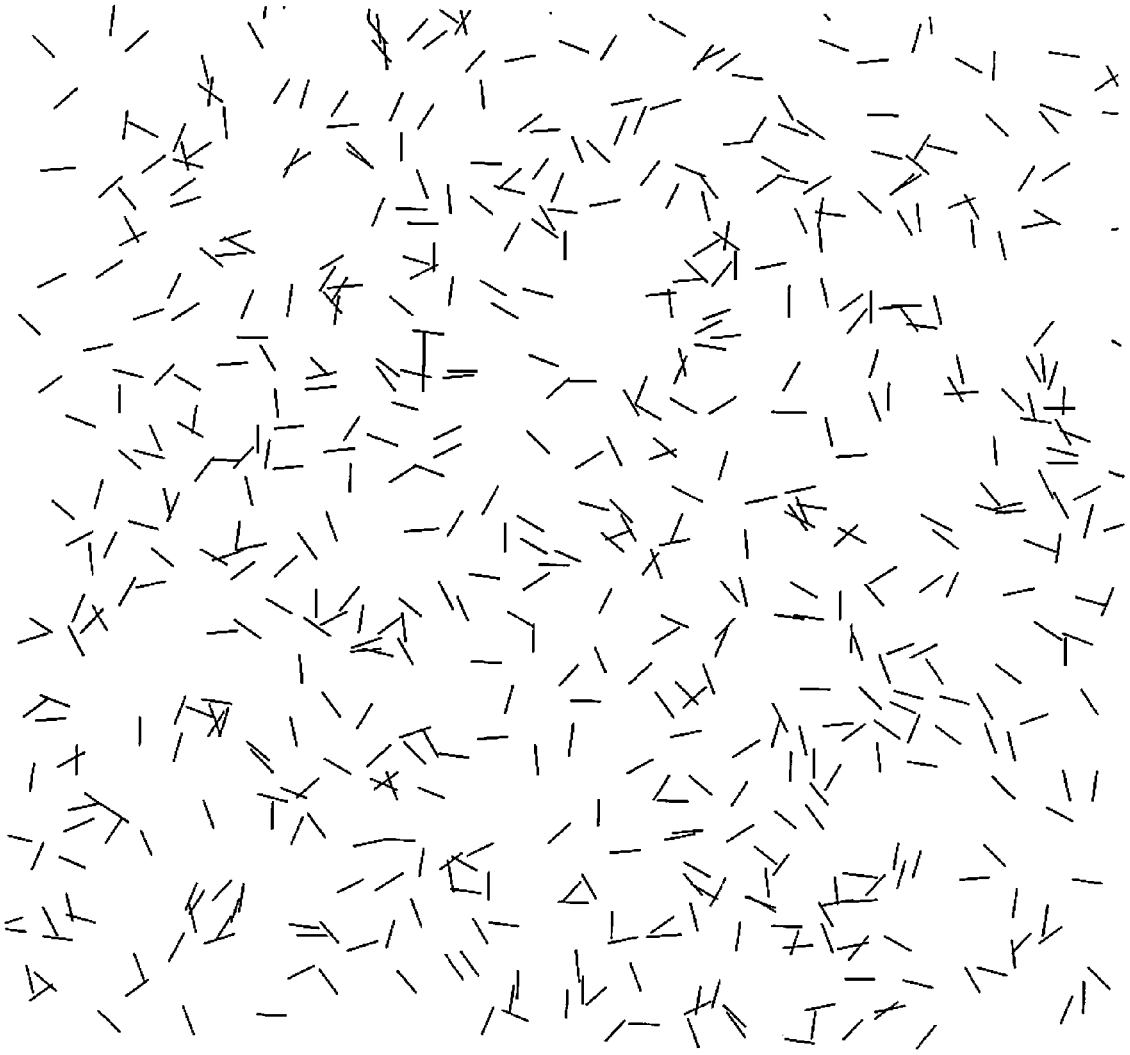
FIG. 2 is a pattern showing a series of medium length tracings in the form of straight line segments. The resulting composite is similar to a conductive fiber-filled dielectric sheet. The length of the fibers (as well as the density, distribution and orientation) determine the material's properties over a frequency range of interest. In addition to the random location and orientation shown, ordered or patterned tracings may also be produced.
Figure 3:
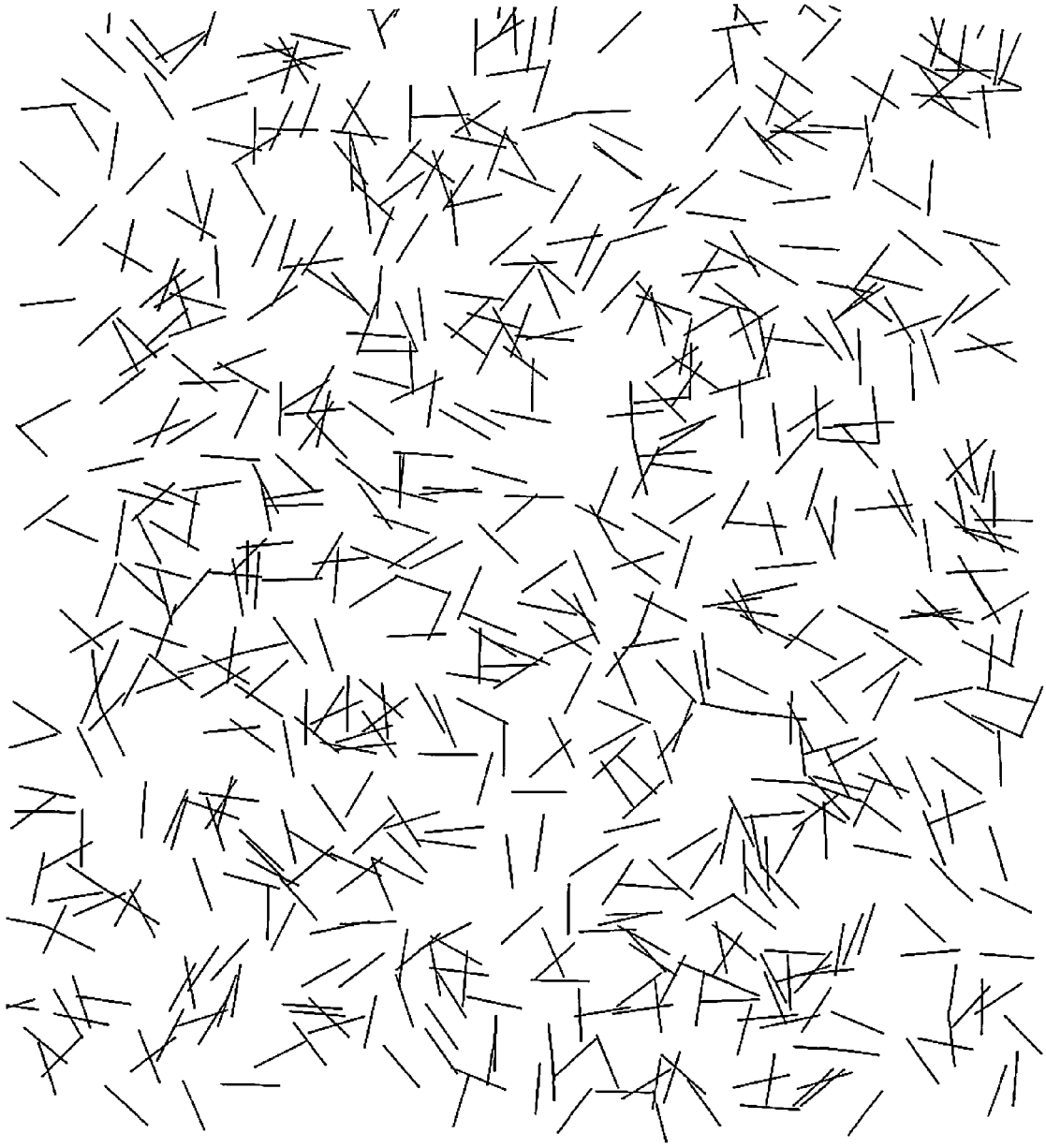
FIG. 3 is a pattern showing a series of long tracings in the form of straight line segments. The resulting composite is similar to a conductive fiber-filled dielectric sheet. The length of the fibers (as well as the density, distribution and orientation) determine the material's properties over a frequency range of interest. In addition to the random location and orientation shown, ordered or patterned tracings may also be produced.
Figure 4:
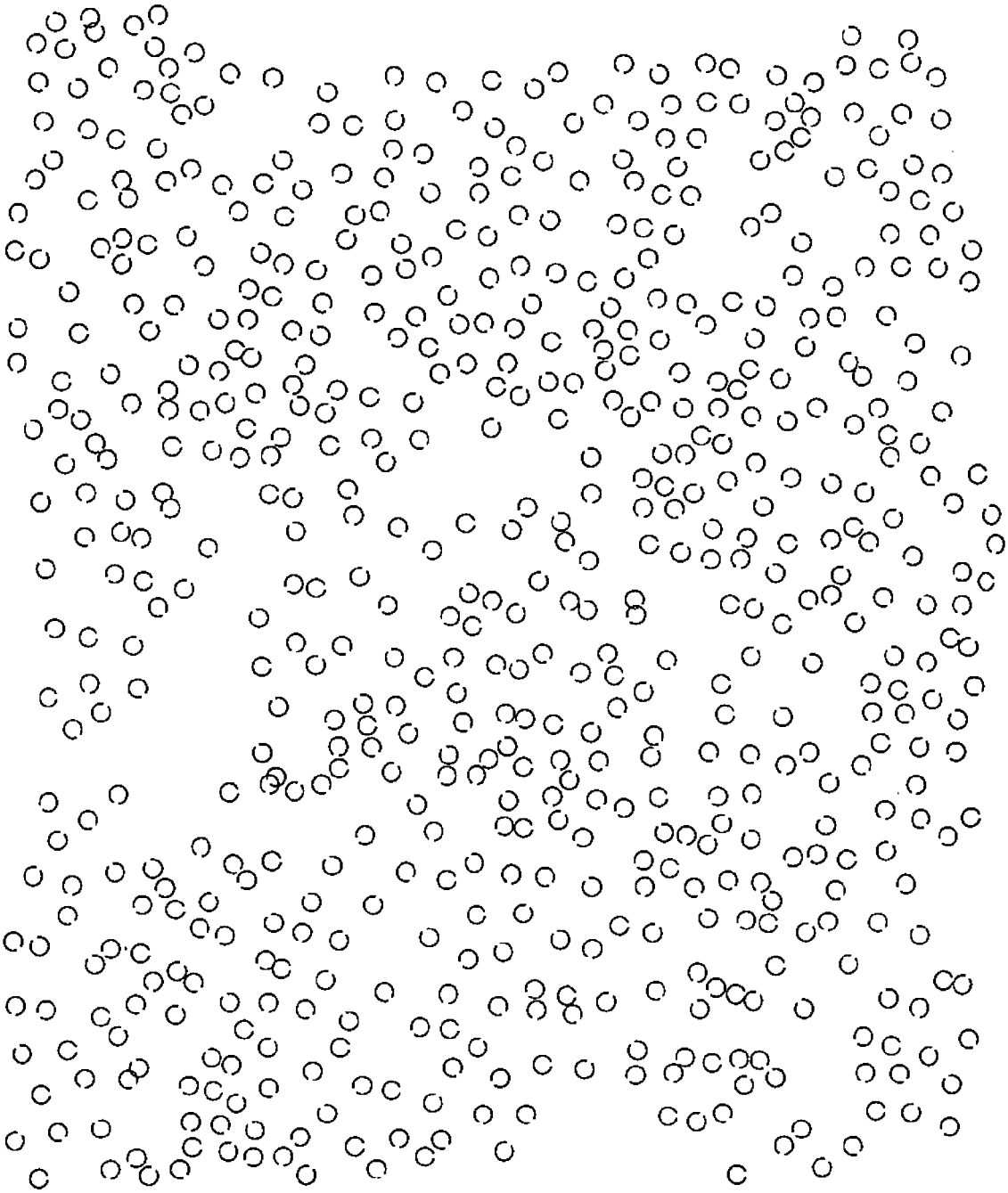
FIG. 4 shows a distribution of uniform but randomly oriented structures. Specialty designs such as resonating structures can be accurately reproduced.
Figure 5:
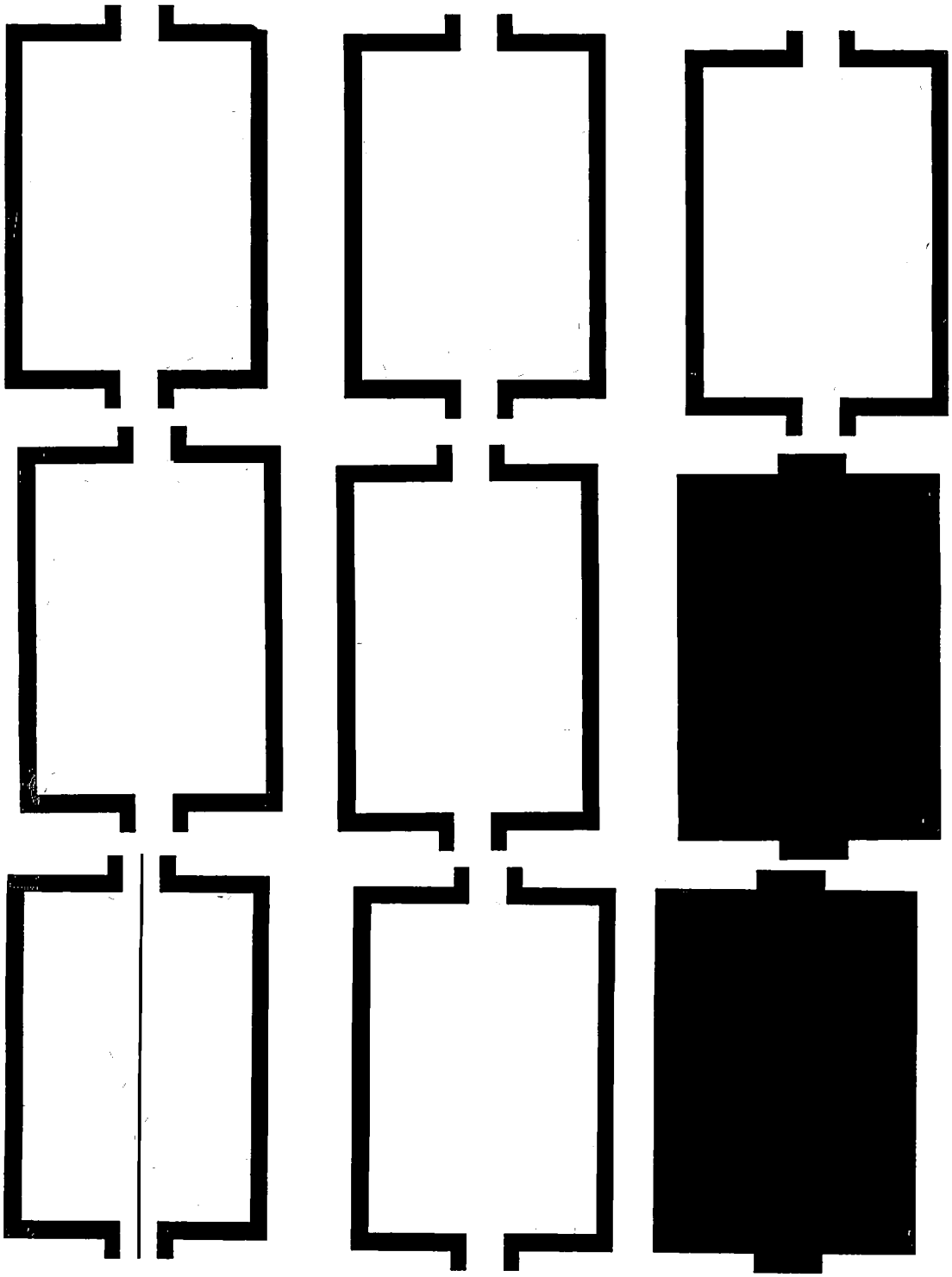
FIG. 5 shows a notional RF device to illustrate the utility for fast-prototyping using the present invention. The figure is composed of nine sections which would be metallized and then cut from the sheet. These sections would be stacked and assembled into an epoxy-based composite. The top and bottom sections are fully metallized over their whole surface. The interior sections are metallized in a thick band around their edges. When assembled, the stack would create a metal-enclosed space. The middle-most layer would contain the single line passing through the end ports. The interior space can be filled (as shown) with fine tracings to modify the dielectric constant of the space as if it were a fiber-filled composite. Fitting would be fabricated to attach this device to a standard coaxial cable.

According to the present invention, a material suitable for use in composites applicable to various electromagnetic needs is prepared using a direct-write method. An electrically non-conducting pattern, typically comprising palladium, is printed onto an electrically non-conducting substrate, typically based on a textile such as paper, using a direct-write device. The pattern is then covered with an electrically conducting coating, typically by immersing the substrate in an electroless plating solution. Metals available for electroless deposition include nickel, gold, silver, palladium, cobalt, iron, and copper. The patterned conductive lines modify the electromagnetic parameters of the material. By controlling the complex dielectric constant of a material, it is possible to construct RF-absorbing composites.

The present invention uses a direct-write device, such as a commercial inkjet printer. Other types of writing devices may be used, including other inkjet technologies as well as specific direct-write devices. Other techniques have been described for the deposition of metal tracings by direct-write, such as precipitation of silver by chemical reduction. These techniques may produce similar results.

The substrate onto which the initial printing is done can be of any appropriate material. Plain paper, both coated and uncoated, as well as Kraft paper, are useful. Plastic sheeting (including coated commercial transparency films) are also useful. High cotton content papers as well as thick card stock are also practical. Large sheet material unsuitable for passage through a printer may be useful for this invention by the use of plotter-type (mobile pen) printing machines. The substrate should be resistant to the processing steps and not active to electroless metallization. Additionally, the dielectric constant of the substrate should be low compared to the final dielectric constant of the composite, and the components of the substrate should be water insoluble.

The pattern size ranges obtainable by this technique depend on the resolution of the printer. Spot sizes are obtainable at about 10 microns. More typical line widths are in the range of 100 microns. There is no limit to the length of printed lines, except the bounds of the substrate. The type of pattern or design to be printed onto the substrate can vary depending on application and the desired properties. The pattern may comprise lines, non-linear structures, or both, and it may have a random or ordered arrangement.

The conductivity of the developed tracings is dependant on the amount of metallization. Development may be continued until the tracings have a conductivity typical for metallic copper. If desired, reduced plating times will yield tracings with varying levels of resistivity, which may be useful for RF absorbing composites.

Another embodiment of the present invention is for multilayer composites. Each layer comprises an electrically non-conducting pattern on an electrically non-conducting substrate and has an electrically conducting coating on the pattern. The layers may have the same or different patterns.

A further embodiment of the present invention is an artificial dielectric composite that includes a material to enhance mechanical properties. Any appropriate material may be used, including carbon fiber fabric, fiberglass, or Kevlar.

The following example is an embodiment of this invention through the patterning of a palladium compound onto paper followed by electroless copper metallization. The ink in a commercial inkjet printer is replaced with a palladium compound and used to print a desired pattern on paper. The palladium is converted to a conductive coating by electroless metallization. The result is a sheet of paper containing conductive metal tracings analogous to a fiber-filled composite.

Step 1. An ink cartridge for an HP Deskjet 3520 was emptied of ink and washed with water by use of a syringe with needle. The cartridge was filled with Cataposit 404 (Shipley), which is a commercial palladium formulation used to sensitize surfaces for electroless metallization. Previous work has shown that Cataposit 404 is extremely reactive with cellulose, which is the main (usually sole) constituent of paper.

Step 2. the ink cartridge was placed in the printer, and used to print patterns on paper.

Step 3. The paper was immersed in electroless plating solution, in this case Shipley Cuposit. It was held within a plastic mesh frame for ease of handling. The plating may be done over a range of temperature (20° C. to 100° C.) but it was found to produce the best plating in a warm bath of about 35° C. to about 45° C.

Step 4. After a suitable plating time (determined by observation of copper-colored metal tracings) the sheet was removed and washed by immersion in a water bath.

Step 5. The sheet was dried. This can be accomplished by air drying, but it is most beneficial to use an apparatus (in this case a Bio-Rad Model 583 Gel Dryer) that is designed to dry flat material under vacuum with applied heat. The result was the recovery of the original paper sheet, now covered with accurately reproduced fine tracings of the desired design, while still retaining all the properties of paper.

The above descriptions are those of the preferred embodiments of the invention. Various modifications and variations are possible in light of the above teachings without departing from the spirit and broader aspects of the invention. It is therefore to be understood that the claimed invention may be practiced otherwise than as specifically described. Any references to claim elements in the singular, for example, using the articles "a," "an," "the," or "said," are not to be construed as limiting the element to the singular.

What is claimed as new and desired to be protected by Letters Patent of the United States is:

1. An artificial dielectric composite, comprising:

a. an electrically non-conducting substrate;

b. an electrically non-conducting pattern on the substrate; and c. an electrically conducting coating on the pattern.

2. The composite of claim 1, wherein the substrate is selected from the group consisting of uncoated paper, coated paper, plastic sheeting, transparency films, high cotton content papers, Kraft paper, and card stock.

3. The composite of claim 1, wherein the pattern comprises a palladium compound.

4. The composite of claim 1, wherein the pattern may comprise lines, line segments, non-linear structures, or any combination thereof, and wherein the pattern may have a random or ordered arrangement.

5. The composite of claim 1, wherein a direct-write device is used to print the pattern onto the substrate.

6. The composite of claim 5, wherein the direct-write device is an inkjet printer.

7. The composite of claim 1, wherein the electrically conducting coating comprises nickel, gold, silver, palladium, cobalt, iron, copper, or any combination thereof.

8. The composite of claim 1, additionally comprising at least one additional electrically non-conducting substrate with an additional electrically non-conducting pattern on the additional substrate and an additional electrically conducting coating on the additional pattern, to form a multi-layer composite.

9. The composite of claim 8, wherein the pattern on each substrate may be the same or different.

10. The composite of claim 1, additionally comprising a material to enhance mechanical properties.

11. The composite of claim 10, wherein the material to enhance mechanical properties is a carbon fiber fabric, fiberglass, or Kevlar.

* * * * *